United States Patent [19]

Velasco R et al.

[11] Patent Number: 4,795,548

[45] Date of Patent: Jan. 3, 1989

[54] PROCESS FOR MAKING ANODE GRADE COKE

[75] Inventors: Leon E. Velasco R; Rafael O. Hidalgo, both of Miranda; Joaquin Rodriguez, Caracas; Wolfgang Garcia, Miranda, all of Venezuela

[73] Assignee: Intevep, S.A., Caracas, Venezuela

[21] Appl. No.: 923,190

[22] Filed: Oct. 27, 1986

[51] Int. Cl.[4] ..... C10G 37/06; C10G 37/02

[52] U.S. Cl. ..... 208/131; 208/127; 208/50

[58] Field of Search ..... 208/127, 131, 50, 53

[56] References Cited

U.S. PATENT DOCUMENTS

| | | | |
|---|---|---|---|
| 2,885,348 | 5/1959 | Brown et al. | 208/127 |
| 2,890,999 | 6/1959 | Polack | 208/127 |
| 3,891,538 | 6/1975 | Walkey | 208/50 |
| 4,075,084 | 2/1978 | Skripek et al. | 208/131 X |
| 4,178,229 | 12/1979 | McConaghy et al. | 208/50 |
| 4,235,700 | 11/1980 | Metrailer | 208/54 |
| 4,351,702 | 9/1982 | Newman et al. | 208/53 X |
| 4,569,751 | 2/1986 | Eidt, Jr. et al. | 208/50 X |

*Primary Examiner*—Glenn Caldarola

*Attorney, Agent, or Firm*—Bachman & LaPointe

[57] ABSTRACT

A process for the production of anode grade coke from a hydrocarbon feed characterized by high levels of sulfur and metals comprises subjecting a vacuum resid to a fluidized bed coking process so as to produce gas, distillates, coke and a residual bottom stream, filtering the residual stream so as to remove solids and thereafter coking the filtered stream.

10 Claims, 1 Drawing Sheet

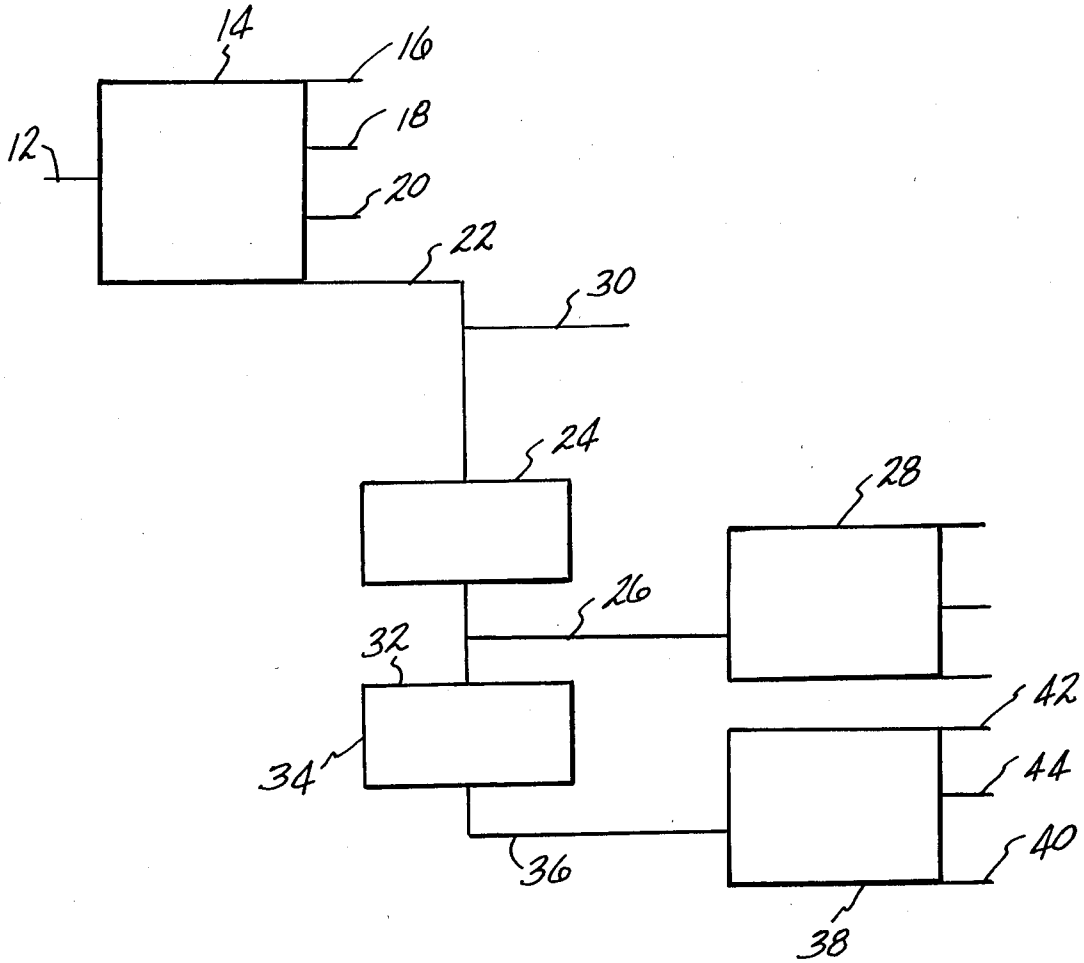
12
14
16
18
20
22
30
24
26
28
32
34
36
38
40
42
44

PROCESS FOR MAKING ANODE GRADE COKE

BACKGROUND OF THE INVENTION

The present invention is drawn to a process for producing anode grade coke and, more particularly, for the production of anode grade coke from a residual product from a fluidized bed coking process.

Heretofore, hydrocarbon feeds characterized by high levels of sulfur and metals have not been successfully processed so as to transform the feeds into products which will produce industrial anode grade coke when subjected to a delayed coking process. Commercial specifications for anode grade calcined coke are as follows: for each metal less than 300 ppm, sulfur 0.4–4.0 wt. %, ash 0.1–4 wt. %, bulk density 82–92 G/100 CC, apparent density 1.65–1.78 G/CC, real density 2.04–2.10 G/CC, electrical resistivity 0.030–0.045 OHM-INCH and porosity 100–240 MM3/G. Heretofore these specifications have not been obtainable when processing hydrocarbon feeds characterized by high levels of sulfur and metals by conventional, economical processes. Conventional processing of typical refining processes of these hydrocarbon feeds results in higher operating costs and generally the production of products which are predominantly of little value and not suitable for anode grade coke.

Naturally, it is highly desirable to provide a process for upgrading feeds characterized by high levels of sulfur and metals so as to allow for the economical production of petroleum products. The process of the present invention should allow for the economic production of coke suitable for the manufacture of anodes for use in the aluminum industry.

Accordingly, it is a principal object of the present invention to provide a process for upgrading hydrocarbon feeds characterized by high levels of sulfur and metals.

It is a particular object of the present invention to provide a process for upgrading hydrocarbon feeds having high levels of sulfur and metals for use in the production of anode grade coke.

Further objects and advantages of the present invention will appear hereinbelow.

SUMMARY OF THE INVENTION

In accordance with the present invention the foregoing objects and advantages are readily obtained.

The present invention relates to a process for the production of anode grade coke from a hydrocarbon feed characterized by high levels of sulfur and metals comprising providing a vacuum resid characterized by the following composition and properties: gravity (°API) −1.0 to 10.0, Conradson carbon (wt. %) 10.0 to 30.0, sulfur (wt. %) 1.0 to 5.0, nitrogen (wt. %) 0.1 to 1.5, vanadium (ppm) 75 to 1000, nickel (ppm) 30 to 250 and subjecting said vacuum resid to a fluidized bed coking process under the following conditions: reactor bed temperature (°F.) 950 to 1000, reactor overhead temperature (°F.) 700 to 800, reactor dense bed pressure (psig) 16 to 20 and reactor diluted bed pressure (psig) 12 to 16 so as to produce gas, distillates, coke and a residual bottom stream characterized by the following composition and properties: gravity (°API) −1.0 to 8.0, Conradson carbon (wt. %) 10.0 to 25.0, sulfur (wt. %) 1.0 to 5.0, nitrogen (wt. %) 0.1 to 1.5, vanadium (ppm) 50 to 500, nickel (ppm) 20 to 80, aromatics (wt. %) 40 to 80, asphaltenes (wt. %) 3.0 to 12.0, solids (wt. %) 0.5 to 3.0 and cut point (°F.+) 800 to 1000; filtering said residual stream so as to remove undesirable solids and produce a filtered clean stream characterized by the following composition and properties: gravity (°API) −1.0 to 8.0, Conradson carbon (wt. %) 10 to 25, sulfur (wt. %) 1 to 5, nitrogen (wt. %) 0.1 to 1.5, vanadium (ppm) 5 to 200, nickel (ppm) 2 to 50, aromatics (wt. %) 40 to 80, asphaltenes (wt. %) 2.0 to 10.0, solids (wt. %) 0 to 0.5 and cut point (°F.+) 800 to 1000; and feeding said filtered clean stream to a coking drum wherein it decomposes leaving a mass of anode grade coke.

The process of the present invention allows for the economic production of valuable anode grade coke for use in the production of electrodes employed in the reduction process used by the aluminum industry.

BRIEF DESCRIPTION OF THE DRAWING

The FIGURE is a schematic flow diagram illustrating the process of the present invention.

DETAILED DESCRIPTION

The present invention is drawn to a process for producing anode grade coke and, more particularly, for the production of anode grade coke from a residual produce from a fluidized bed coking process.

With reference to the Figure, a vacuum resid characterized by the following composition and properties: gravity (°API) −1.0 to 10.0, Conradson carbon (wt. %) 10.0 to 30.0, sulfur (wt. %) 1.0 to 5.0, nitrogen (wt. %) 0.1 to 1.5, vanadium (ppm) 75 to 1000, nickel (ppm) 30 to 250 and is fed via line 12 to a fluidized bed coking reactor 14 wherein the vacuum resid is processed under the following conditions: reactor bed temperature (°F.) 950 to 1000, reactor overhead temperature (°F.) 700 to 800, reactor dense bed pressure (psig) 16 to 20 and reactor diluted bed pressure (psig) 12 to 16 so as to produce gas which is drawn off via line 16, distillates which are drawn off via line 18, coke, known as Flexicoke, which is drawn off via line 20 and a residual bottom stream characterized by the following composition and properties: gravity (°API) −1.0 to 8.0, Conradson carbon (wt. %) 10.0 to 25.0, sulfur (wt. %) 1.0 to 5.0, nitrogen (wt. %) 0.1 to 1.5, vanadium (ppm) 50 to 500, nickel (ppm) 20 to 80, aromatics (wt. %) 40 to 80, asphaltenes (wt. %) 3.0 to 12.0, solids (wt. %) 0.5 to 3.0 and cut point (°F.+) 800 to 1000, which is drawn off via line 22. The fluidized bed coking of a high metals content vacuum residual having the composition and properties set forth above results in the production of a residual bottom stream having a lower metals content and a higher aromatic content than the vacuum residual. The metals left in the residual bottom stream are deposited mostly on the coke produced in the fluidized bed coking unit, which coke is readily removed from the recycled stream in later processing. The residual bottom stream having the foregoing composition and properties is thereafter fed to a filtering chamber 24 wherein the residual stream is filtered so as to remove undesirable solids and metals from the residual stream so as to produce a filtered clean stream having the following composition and properties: gravity (°API) −1.0 to 8.0, Conradson carbon (wt. %) 10.0 to 25.0, sulfur (wt. %) 1.0 to 5.0, nitrogen (wt. %) 0.1 to 1.5, vanadium (ppm) 5 to 200, nickel (ppm) 2 to 50, aromatics (wt. %) 40 to 80, asphaltenes (wt. %) 2.0 to 10.0, solids (wt. %) 0 to 0.5 and cut point (°F.+) 800 to 1000. The filtered clean stream is thereafter fed to a coking drum 28 via line 26 where it is subjected to coking under the following conditions: coking pressure (psig) 15 to 120, coking temperature (°C.) 410 to 480, recycle ratio 1:1 to 2:1 wherein the clean filtered stream decomposes leaving a mass of anode grade coke.

In accordance with the present invention it has been found that the use of the residual stream from a fluidized bed coking unit allows for the production of good quality anode grade coke as well as lighter distillates of higher commercial value. In addition, due to the high aromatic content (greater than 40 wt. %) of these streams, a highly crystilline needle coke, especially suitable for the production of graphite electrodes, can be obtained when delayed coked under the foregoing conditions.

As noted above, before coking the residual stream from the fluidized bed coking unit, it is necessary that the residual stream be filtered in order to remove undesirable solids (coking, catalyst fines) of high metal content. Typical filtration techniques such as centrifugal, electrostatic or mechanical techniques allow for an efficient removal of the undesirable solids in the area of 85 to 90%. In accordance with a preferred embodiment of the present invention, it is desirable and preferred that a diluent be mixed with the residual stream via line 30 prior to the filtration of the residual stream. In accordance with the present invention the diluent should be compatible with the recycle stream, that is, aromatic, and should be mixed in a proportion to the residual stream in an amount from about 40 to 75% volume of residual to 25 to 60% volume diluent. Suitable diluents include decanted oils having the following composition and properties: gravity (°API) −1.0 to 7.0, Conradson carbon (wt. %) 0.5 to 6.0, sulfur (wt. %) 1.0 to 3.0, nitrogrn (wt. %) 0.1 to 0.5, vanadium (ppm) 0.5 to 10, nickel (ppm) 0.1 to 5.0, aromatics (wt. %) 50 to 85, asphaltenes (wt. %) 0.1 to 3.0, and solids (wt. %) 0.01 to 0.5 and lubricant extracts having the following composition and properties: gravity (°API) 10 to 20, Conradson carbon (wt. %) 0.05 to 2.5, sulfur (wt. %) 1.5 to 3.0, nitrogen (wt. %) 0.1 to 0.5, vanadium (ppm) 0.1 to 10, nickel (ppm) 0.01 to 5.0, aromatics (wt. %) 55.0 to 75.0, and asphaltenes (wt. %) 0.05 to 0.5. It is preferred that the residual stream be filtered at a temperature of at least 270° F.

The filtered residual stream can thereafter be taken via line 26 directly to delayed coking unit 28 or delivered via line 32 to a hydrodesulfurization unit 34. In some cases in order to produce needle coke within the required specifications the sulfur content must be lowered. This is accomplished by hydrotreating the filtered residual stream either blended or unblended as discussed above under the following hydrotreatment conditions: hydrogen pressure (psig) 500–2000, temperature (°F.) 620–790, space velocity (1/h) 0.2–2.0, H2/feed ratio (N m3/m3) 200–1500, and catalyst Group VI and Group VII metals on a refractory support. The catalytic hydrodesulfurized stream is thereafter fed via line 36 to delayed coker 38 so as to produce metallurgical coke via line 40 and gas and distillates via line 42 and 44, respectively.

Advantages of the present invention will be made clear from the following illustrative examples.

EXAMPLE I

A vacuum residual having the following composition and properties: gravity (°API) 5.0, Conradson carbon (wt. %) 20.0, sulfur (wt. %) 3.2, nitrogen (wt. %) 0.6, vanadium (ppm) 580, nickel (ppm) 65, was fed to a fluidized bed coking unit wherein it was treated under the following conditions: reactor bed temperature (°F.) 975, reactor overhead temperature (°F.) 750, reactor dense bed pressure (psig) 18, reactor diluted bed pressure (psig) 14, so as to produce a residual bottom stream having the following composition and properties: gravity (°API) 4.0, Conradson carbon (wt. %) 20.9, sulfur (wt. %) 3.1, nitrogen (wt. %) 0.7, vanadium (ppm) 403, nickel (ppm) 39, aromatics (wt. %) 74.0, asphaltenes (wt. %) 5.5, solids (wt. %) 1.5 and cut point (°F.+) 950. The residual bottom stream was filtered at 275° F. using a 25-micron stainless steel in line filter. The properties of the filtered residual bottom stream were as follows: gravity (°API) 4.0, Conradson carbon (wt. %) 19.8, sulfur (wt. %) 3.0, nitrogen (wt. %) 0.7, vanadium (ppm) 100, nickel (ppm) 14, aromatics (wt. %) 74.0, asphaltenes (wt. %) 4.0, solids (wt. %) 0.2 and cut point (°F.+) 950. The filtered recycle stream was thereafter coked under the following conditions: coking pressure 60 psig, coking temperature 443° C., so as to produce the following product yields: gas (C4−) 10.0 wt. %, distillates (C5-510° C.) 46.4 wt. %, green coke 43.6 wt. %. The characteristics of the green coke produced were as follows: volatile combustible material (wt. %) 10.2, vanadium (ppm) 200.0, nickel (ppm) 28.0, sulfur (wt. %) 3.9. After a 24 hour static calcination at a furnace at 1100° C. the following characteristics were obtained for the calcined coke: volatile combustible material (wt. %) less than 0.5, vanadium (ppm) 250, nickel (ppm) 47.0, sulfur (wt. %) 3.4, real density (g/cc) 2.1, electric resistivity, (ohm-inch) 0.036, vibrated bulk density (g/100 cc) 83.0 and apparent density (g/cc) 1.7. The coke produced above is an anode grade coke suitable for metallurgical purposes.

EXAMPLE II

The residual bottom stream from Example I was blended in a ratio of 2 to 1 by volume with a decanted oil stream having the following characteristics: gravity (°API) 2.3, Conradson carbon (wt. %) 3.0, sulfur (wt. %) 2.0, nitrogen (wt. %) 0.2, vanadium (ppm) 1.0, nickel (ppm) 0.3, aromatics (wt. %) 70.0, asphaltenes (wt. %) 1.0, and solids (wt. %) 01.05, so as to produce a blended stream having the following characteristics and properties: gravity (°API) 3.4, Conradson carbon (wt. %) 14.9, sulfur (wt. %) 2.7, nitrogen (wt. %) 0.5, vanadium (ppm) 268.0, nickel (ppm) 26.0, kinetic viscosity @275° F., 120.0, aromatics (wt. %) 73.0, asphaltenes (wt. %) 4.0, and solids (wt. %) 1.0. The blended stream was thereafter filtered at a temperature of 275° F. with a 25-micron stainless steel in line filter to yield a filtered blend having the following composition and properties: gravity (°API) 3.4, Conradson carbon (wt. %) 14.2, sulfur (wt. %) 2.7, nitrogen (wt. %) 0.5, vanadium (ppm) 67.0, nickel (ppm) 9.0, viscosity @275° F., 120.0 C.P., aromatics (wt. %) 73.0, asphaltenes (wt. %) 3.0, and solids (wt. %) 0.1. The blend was thereafter coked under the same conditions as Example I so as to give the following product yields: gas (C4−) 9.2 wt. %, distillates (C5-510° C.) 49.0 wt. %, green coke 41.8 wt. %. The characteristics of the green coke were as follows: volatile combustible material (wt. %) 10.0, vanadium (ppm) 160.0, nickel (ppm) 23.0, sulfur (wt. %) 3.5. The green coke was thereafter calcined in the same manner as Example I yielding a calcined coke having the following characteristics and properties: volatile combustible material (wt. %) less than 0.5, vanadium (ppm)

200, nickel (ppm) 39, sulfur (wt. %) 3.1, real density (g/cc) 2.1, electric resistivity (ohm-inch) 0.03, vibrated bulk density (g/100 cc) 85.0 and apparent density (g/cc) 1.72. As can be seen the coke produced from the blended residual stream is a better quality than that produced employing the unblended residual stream.

EXAMPLE III

A test identical to that of Example II was run except that the residual stream from the fluidized bed coking unit was blended with a lubricant extract having the following composition and properties: gravity (°API) 14.0, Conradson carbon (wt. %) 1.0, sulfur (wt. %) 2.5, nitrogen (wt. %) 0.3, vanadium (ppm) 5.0, nickel (ppm) 1.0, kinematic viscosity @210° F., 35.0 C.P., aromatics (wt. %) 70.0, asphaltenes (wt. %) 0.1, in a volume of 2 to 1 so as to produce a blended residual stream having the following composition and properties: gravity (°API) 7.2, Conradson carbon (wt. %) 14.6, sulfur (wt. %) 2.9, nitrogen (wt. %) 0.6, vanadium (ppm) 277.0, nickel (ppm) 27.0, aromatics (wt. %) 73.0, asphaltenes (wt. %) 3.8, and solids (wt. %) 1.0. After filtering and coking in the manner described in Example I the product yields were as follows: gas (C4−) 9.1 wt. %, distillates (C5-510° C.) 54.1 wt. %, green coke 36.8 wt. %. The green coke characteristics were as follows: volatile combustible material, wt. % 10.5, vanadium (ppm) 186.0, nickel (ppm) 26.3, sulfur (wt. %) 3.6. After calcining in the manner set forth above with reference to Example I, the calcined coke had the following composition and properties: volatile combustible material (wt. %) less than 0.5, vanadium (ppm) 242.0, nickel (ppm) 47.0, sulfur (wt. %) 3.3, real density (g/cc) 2.05, electric resistivity (ohm-inch) 0.045, vibrated bulk density (g/100 cc) 82.0 and apparent density (g/cc) 1.69. Again, as was the case in Examples I and II, the calcined coke produced by the process of the present invention is anode grade coke suitable for metallurgical purposes.

EXAMPLE IV

The blend of Example II was subjected to catalytic hydrodesulfurization under the following conditions prior to the delayed coking thereof: H2 pressure (psig) 1500, temperature (°C.) 381, space velocity (1/h) 0.5, H2/feed ratio (N m3/m3) 100 and catalyst Co-Mo/Al$_2$O$_3$. The resultant hydrodesulfurized product had the following characteristics: gravity (°API) 10.7, sulfur (wt. %) 0.73, nitrogen (wt. %) 0.3, Conradson carbon (wt. %) 7.0 and aromatics (wt. %) 70.0. The hydrodesulfurized product was coked under the following conditions: coking pressure 100 psig and coking temperature 450° C., so as to produce the following yields: gas (C4−) 11.4 wt. %, distillates (C5-510° C.) 42.8 wt. % and green coke 45.8 wt. %. After 24 hours static calcination in a furnace at 1250° C., the needle coke showed a coefficient of thermal expansion of 6×10 power (−7) 1/deg. °C. and a sulfur content of 1.0 wt. %.

EXAMPLE V

The blend of Example III was hydrodesulfurized under the same conditions set forth above with respect to Example IV. The hydrodesulfurized product had the following characteristics: gravity (°API) 14.9, sulfur (wt. %) 0.65, nitrogen (wt. %) 0.31, Conradson carbon (wt. %) 6.5 and aromatics (wt. %) 69.0. The hydrodesulfurized product was thereafter coked under the exact conditions of Example IV wherein the following yields were obtained: gas (C4−) 9.6 wt. %, distillates (C5-510° C.) 49.0 wt. % and green coke 41.4 wt. %. After calcining under the same conditions of Example IV the needle coke showed a coefficient of thermal expansion of 7×10 power (−7) 1/deg. °C. and a sulfur content of 0.92 wt. %.

As can clearly be seen from the foregoing, the process of the present invention allows for the production of anode grade coke from a vacuum resid characterized by high levels of sulfurs and metals. The process of the present invention allows for the economic production of coke suitable for the manufacture of anodes for use in the aluminum industry.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for the production of anode grade coke from a hydrocarbon feed characterized by high levels of sulfur and metals comprising:

(a) providing a vacuum resid characterized by the following composition and properties:

| | |
|---|---|
| Gravity, °API | −1.0 to 10.0 |
| Conradson Carbon, wt. % | 10.0 to 30.0 |
| Sulfur, wt. % | 1.0 to 5.0 |
| Nitrogen, wt. % | 0.1 to 1.5 |
| Vanadium, ppm | 75 to 1000 |
| Nickel, ppm | 30 to 250 |

(b) subjecting said vacuum resid to a fluidized bed coking process under the following conditions:

| | |
|---|---|
| Reactor Bed Temperature, °F. | 950 to 1000 |
| Reactor overhead temperature, °F. | 700 to 800 |
| Reactor Dense Bed Pressure, psig | 16 to 20 |
| Reactor Diluted Bed Pressure, psig | 12 to 16 |

so as to produce gas, distillates, coke and a residual bottom stream characterized by the following composition and properties:

| | |
|---|---|
| Gravity, °API | −1.0 to 8.0 |
| Conradson Carbon, wt. % | 10.0 to 25.0 |
| Sulfur, wt. % | 1.0 to 5.0 |
| Nitrogen, wt. % | 0.1 to 1.5 |
| Vanadium, ppm | 50 to 500 |
| Nickel, ppm | 20 to 80 |
| Aromatics, wt. % | 40 to 80 |
| Asphaltenes, wt. % | 3.0 to 12.0 |
| Solids, wt. % | 0.5 to 3.0 |
| Cut Point, °F.+ | 800 to 1000 |

(c) filtering said residual stream so as to remove undesirable solids of high metal content and produce a filtered clean stream characterized by the following composition and properties:

| | |
|---|---|
| Gravity, °API | −1.0 to 8.0 |
| Conradson Carbon, wt. % | 10 to 25 |
| Sulfur, wt. % | 1 to 5 |
| Nitrogen, wt. % | 0.1 to 1.5 |
| Vanadium, ppm | 5 to 200 |
| Nickel, ppm | 2 to 50 |

-continued

| | |
|---|---|
| Aromatics, wt. % | 40 to 80 |
| Asphaltenes, wt. % | 2.0 to 10.0 |
| Solids, wt. % | 0 to 0.5 |
| Cut Point, °F.+ | 800 to 1000 |

(d) feeding said filtered clean stream to a coking drum wherein it decomposes leaving a mass of anode grade coke.

2. A process according to claim 1 wherein said residual stream is filtered at a temperature of at least 270° F.

3. A process according to claim 1 wherein said filtered clean stream is coked under the following conditions:

| | |
|---|---|
| Coking Pressure, psig | 15 to 120 |
| Coking Temperature, °C. | 410 to 480 |
| Recycle Ratio | 1:1 to 2:1. |

4. A process according to claim 1 wherein said residual stream is blended with decanted oil characterized by the following composition and properties:

| | |
|---|---|
| Gravity, °API | −1 to 7.0 |
| Conradson Carbon, wt. % | 0.5 to 6.0 |
| Sulfur, wt. % | 1.0 to 3.0 |
| Nitrogen, wt. % | 0.1 to 0.5 |
| Vanadium, ppm | 0.5 to 10 |
| Nickel, ppm | 0.1 to 5.0 |
| Aromatics, wt. % | 50 to 85 |
| Asphaltenes, wt. % | 0.1 to 3.0 |
| Solids content, wt. % | 0.01 to 0.5 |

in a proportion from about 40 to 75 volume percent of residual and 25 to 60 volume percent of decanted oil prior to filtering.

5. A process according to claim 1 wherein the filtered clean stream is subjected to catalytic hydrodesulfurization under the following conditions:

| | |
|---|---|
| Hydrogen Pressure, psig | 500–2000 |
| Temperature, °F. | 620–790 |
| Space Velocity, l/h | 0.2–2.0 |
| H2/feed ratio, N m3/m3 | 200–1500 |

in the presence of a catalyst comprising a refractory support having metals selected from Group VIB and Group VIII of the Periodic Table deposited thereon.

6. A process according to claim 4 wherein the filtered clean blended stream is subjected to catalytic hydrodesulfurization under the following conditions:

| | |
|---|---|
| Hydrogen Pressure, psig | 500–2000 |
| Temperature, °F. | 620–790 |
| Space Velocity, l/h | 0.2–2.0 |
| H2/feed ratio, N m3/m3 | 200–1500. |

7. A process according to claim 6 wherein said filtered clean stream is coked under the following conditions:

| | |
|---|---|
| Coking Pressure, psig | 15 to 120 |
| Coking Temperature, °C. | 410 to 480 |
| Recycle Ratio | 1:1 to 2:1. |

8. A process according to claim 1 wherein said recycle stream is blended with a lubricant extract characterized by the following composition and properties:

| | |
|---|---|
| Gravity, °API | 10 to 20 |
| Conradson Carbon, wt. % | 0.05 to 2.5 |
| Sulfur, wt. % | 1.5 to 3.0 |
| Nitrogen, wt. % | 0.1 to 0.5 |
| Vanadium, ppm | 0.1 to 10 |
| Nickel, ppm | 0.01 to 5.0 |
| Aromatics, wt. % | 55.0 to 75.0 |
| Asphaltenes, wt. % | 0.05 to 0.5 |

in a proportion from about 40 to 75 volume percent of recycle and 25 to 60 volume percent of lubricant extract prior to filtering.

9. A process according to claim 8 wherein the filtered clean blended stream is subjected to catalytic hydrodesulfurization under the following conditions:

| | |
|---|---|
| Hydrogen Pressure, psig | 500–2000 |
| Temperature, °F. | 620–790 |
| Space Velocity, l/h | 0.2–2.0 |
| H2/feed ratio, N m3/m3 | 200–1500. |

10. A process according to claim 9 wherein said filtered clean stream is coked under the following conditions:

| | |
|---|---|
| Coking Pressure, psig | 15 to 120 |
| Coking Temperature, °C. | 410 to 480 |
| Recycle Ratio | 1:1 to 2:1. |

* * * * *